US007018248B2

(12) United States Patent
Schulz

(10) Patent No.: US 7,018,248 B2
(45) Date of Patent: Mar. 28, 2006

(54) DEVICE FOR FORMING CONNECTION ELEMENTS

(75) Inventor: Reiner Schulz, Düsseldorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/504,752

(22) PCT Filed: Feb. 17, 2003

(86) PCT No.: PCT/IB03/00529

§ 371 (c)(1),
(2), (4) Date: Aug. 17, 2004

(87) PCT Pub. No.: WO03/071638

PCT Pub. Date: Aug. 28, 2003

(65) Prior Publication Data

US 2005/0118893 A1 Jun. 2, 2005

(30) Foreign Application Priority Data

Feb. 21, 2002 (DE) ..... 102 07 272

(51) Int. Cl.
*H01R 13/02* (2006.01)

(52) U.S. Cl. ..... 439/885

(58) Field of Classification Search ..... 439/885, 439/78–82, 876
See application file for complete search history.

(56) References Cited

U.S. PATENT DOCUMENTS 4,978,307 A * 12/1990 Billman et al. ..... 439/83
5,060,372 A * 10/1991 Capp et al. ..... 29/883
5,759,053 A * 6/1998 Sugiyama ..... 439/212
5,848,920 A * 12/1998 Klein et al. ..... 439/885
5,975,959 A * 11/1999 Joly ..... 439/630
6,139,377 A * 10/2000 Chen ..... 439/885
6,837,748 B1 * 1/2005 Aldridge ..... 439/660

* cited by examiner

*Primary Examiner*—Gary Paumen

(57) ABSTRACT

The invention relates to a device for forming connections of a printed circuit board which is arranged within a signal receiver frame. The device comprises a plurality of connection elements (3*a* . . . 3*k*) whose end portions are bent, each end portion being provided with at least one projection (5). Between each time two connection elements (3*a* . . . 3*k*) there is provided a respective detainer (4*a* . . . 4*j*) whose end portion is also bent. The end portions of the connection elements (3*a* . . . 3*k*) define a plane which extends parallel to a plane defined by the end portions of the detainers (4*a* . . . 4*j*).

7 Claims, 2 Drawing Sheets

DEVICE FOR FORMING CONNECTION ELEMENTS

The invention relates to a device for forming connection elements for connecting a printed circuit board to other electrical components. The invention also relates to an arrangement which includes a frame for a signal receiver with a device for forming connection elements of a printed circuit board, and also to a method of forming connection elements of a printed circuit board.

Signal receivers of this kind process practically all electrical signals and transfer such signals to other electrical components for further processing. Such other electrical components may be other printed circuit boards, for example, a so-called main board of a television set or a TV card of a PC. The signal receiver itself consists of a frame in which various SMDs (Surface Mounted Devices) are mounted on the surface of a printed circuit board.

For the mounting of the printed circuit board first solder paste is deposited on the printed circuit board in a predetermined pattern while using a screen printing method. Subsequently, the SMDs are positioned on the printed circuit board and possibly fixed to the surface of the printed circuit board by means of a non-conductive adhesive; the connections of the devices then come into contact, in given locations, with the solder paste pattern printed on the printed circuit board. The devices themselves and their connections are situated on the same side of the printed circuit board. Subsequently, a so-called reflow soldering process is carried out. The solder on the printed circuit board is then melted by application of heat in a suitable furnace, thus forming fixed electrical soldered connections between the SMDs and the printed circuit board.

The transfer of the signals between the signal receiver and other circuit components requires the use of devices which conduct the electrical signals from the printed circuit board to the components. To this end, known embodiments are provided with connection elements or pin stripes which are embedded in thin plastic strips and are arranged, together with the SMDs, on the printed circuit board after the application of the solder paste. The plastic strips then act as a guide for the connection elements and provide an insulated connection to the frame.

It is a drawback that an additional surface area is occupied thereby on the printed circuit board and the necessary, but also problematic, tolerances of the plastic strips, for example, the distance between the connection elements, bent plastic strips, fluctuations occurring in the material and during the processing, also form a drawback. A further disadvantage resides in the additional costs of the plastic material used, since this material may not become liquefied at the high temperatures occurring during the reflow soldering process. Such additional costs cannot be ignored, that is, in particular in the case of mass production. As an alternative it is known to use separate connection elements which are soldered onto the printed circuit board by hand only after completion of the reflow soldering process; however, this leads to additional costs of labor.

It is an object of the invention to provide a device for forming connections of a printed circuit board arranged within a signal receiver frame, which device has a high mechanical stability, a high thermal strength and can be mounted as economically as possible.

This object is achieved in that the device comprises a plurality of connection elements having a bent end portion, a respective detainer, having a bent end portion, being provided between each time two connection elements, and the end portions of the connection elements defining a plane which extends parallel to a plane defined by end portions of the detainers.

During the mounting of the device the connection elements are inserted into a plurality of holes in the printed circuit board which are provided for the connection elements. The printed circuit board is then situated in the frame of the signal receiver, so that the connection elements bear on the frame or the printed circuit board via the detainers which bear on the frame. The connection strip serves for guiding and for stable positioning of the detainers.

After insertion of the connection elements of the device into the printed circuit board, a soldering process is performed during which the frame, the printed circuit board and the connection elements are soldered to one another. After completion of the soldering process, the connection strip is separated and the detainers are removed.

Because the connection elements are supported by the detainers, the entire device can be provided on the printed circuit board in a stable manner. Undesirable bending of the device is prevented by the detainers as well as by the connection strip. The manufacture of such a device is very simple so that the costs of manufacturing the signal receiver are reduced.

The device consists of one piece only and is uniformly made of an electrically conductive material, for example, sheet metal. It is punched in its entirety from the material and bent as necessary. This leads to a higher stability of the connection elements, notably because there are no transitions between different of the connection element and the connection strip.

Because of the use of only a single material, the device is less subject to mechanical strains since different thermal expansion coefficients do not occur within the device. This property becomes manifest notably during the soldering process. At the same time an increased temperature stability can be achieved by choosing the appropriate material.

The connection elements and the detainers are preferably L-shaped. The use of an L-shape for the connection elements and the detainers ensures stability of the device during mounting, because the detainers can perform a supporting function on a right-angled frame so that the entire device can be stabilized during the introduction of the connection elements into the printed circuit board.

The embodiment in conformity with claim 5 offers the advantage that a projection of the end portion additionally stabilizes the connection element in its position in a further application of the connection elements. The mounting of a module (for example, a signal receiver) on a main board (for example, a television set, a PC board) can be performed by means of a soldering operation. The connection elements are then heated again so that they could drop out of the printed circuit board or fall over due to the liquefying of the soldered connection. As a result of the stepped projection of the end portion, the connection element bears on the printed circuit board so that its position does not change when the soldered connection is liquefied.

The invention also relates to an arrangement which includes a frame which is intended in particular for receiving a printed circuit board for a signal receiver with a device connected to the frame. The device then consists of a plurality of right-angled connection elements which are arranged at equal distances from one another. The connection elements serve as an electrical connection between the printed circuit board and other components, for example, other printed circuit boards. Between two connection elements there is provided a respective detainer which serves to stabilize the position of the device. The connection elements are guided in the frame and the printed circuit board by a connection strip of the device. The connection strip positions and stabilizes the detainers on the frame.

The invention also relates to a method of manufacturing connection elements of a printed circuit board for connection to a frame of a signal receiver. A device which comprises a plurality of connection elements with a bent end portion and a respective detainer, having a bent end portion, between each time two connection elements, is attached to the frame prior to the soldering of the connection elements. The end portions of the connection elements define a plane which extends parallel to a plane defined by the end portions of the detainers. The connection elements are inserted into the printed circuit board and at the same time the device is supported on the frame and/or the printed circuit board via the detainers. The connection elements are separated from the device after completion of the soldering operation.

Embodiments of the invention will be described in detail hereinafter with reference to the Figures. Therein:

Figure 1:
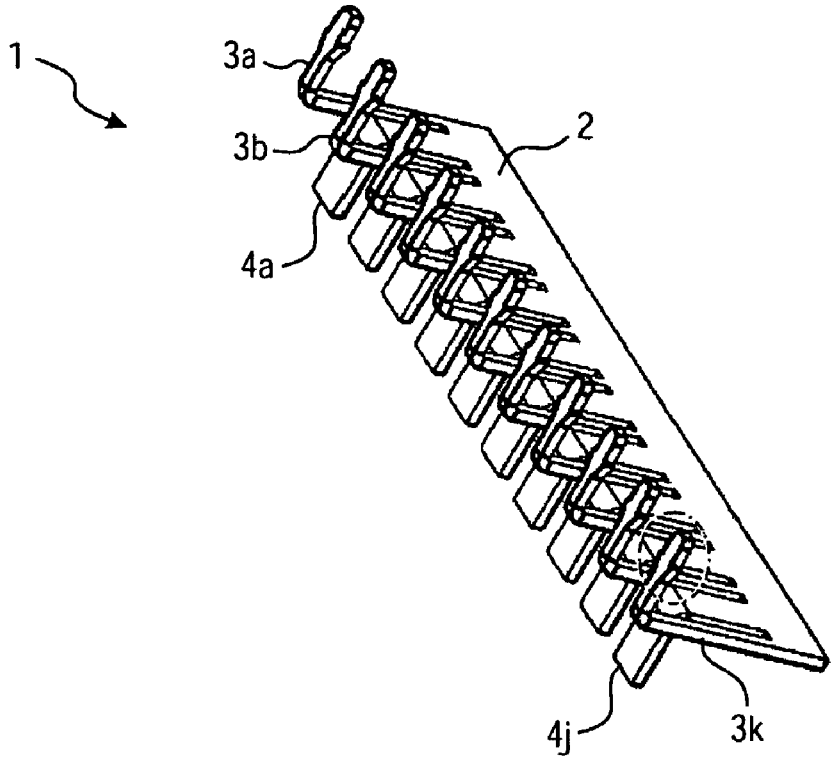
FIG. 1 shows a device.

The device 1 shown in FIG. 1 is punched from an electrically conductive material, for example, sheet metal, and bent to the appropriate shape.

Figure 2:
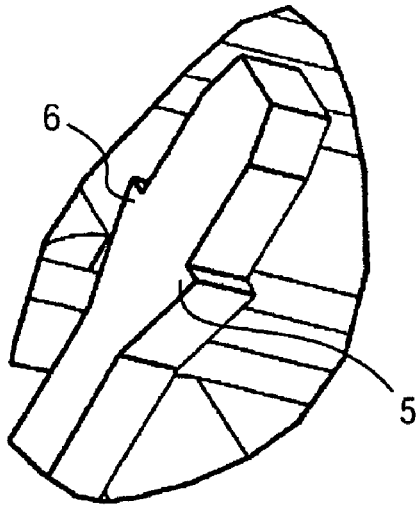
FIG. 2 shows a detail of a connection element at an increased scale.

The device consists of a connection strip 2 and a plurality of L-shaped connection elements 3*a* . . . 3*k*. An end portion of each connection element 3*a* . . . 3*k* is bent at right angles and is provided with two projections 5 and 6 whereby the connection elements 3*a* . . . 3*k* are supported on a printed circuit board. FIG. 2 shows the projections at an increased scale for the sake of clarity.

Between each time two connection elements 3*a* and 3*b* there is provided a respective L-shaped detainer 4*a* . . . 4*j* whose end portion is also bent at right angles.

The connection strip 2 is intended to guide the connection elements 3*a* . . . 3*k* and to stabilize the detainers 4*a* . . . 4*j*. The detainers 4*a* . . . 4*j* fix the position of the device 1 while the printed circuit board is subjected to a soldering process during which the connection elements are soldered. To this end, they bear on the frame of the signal receiver.

Figure 3:
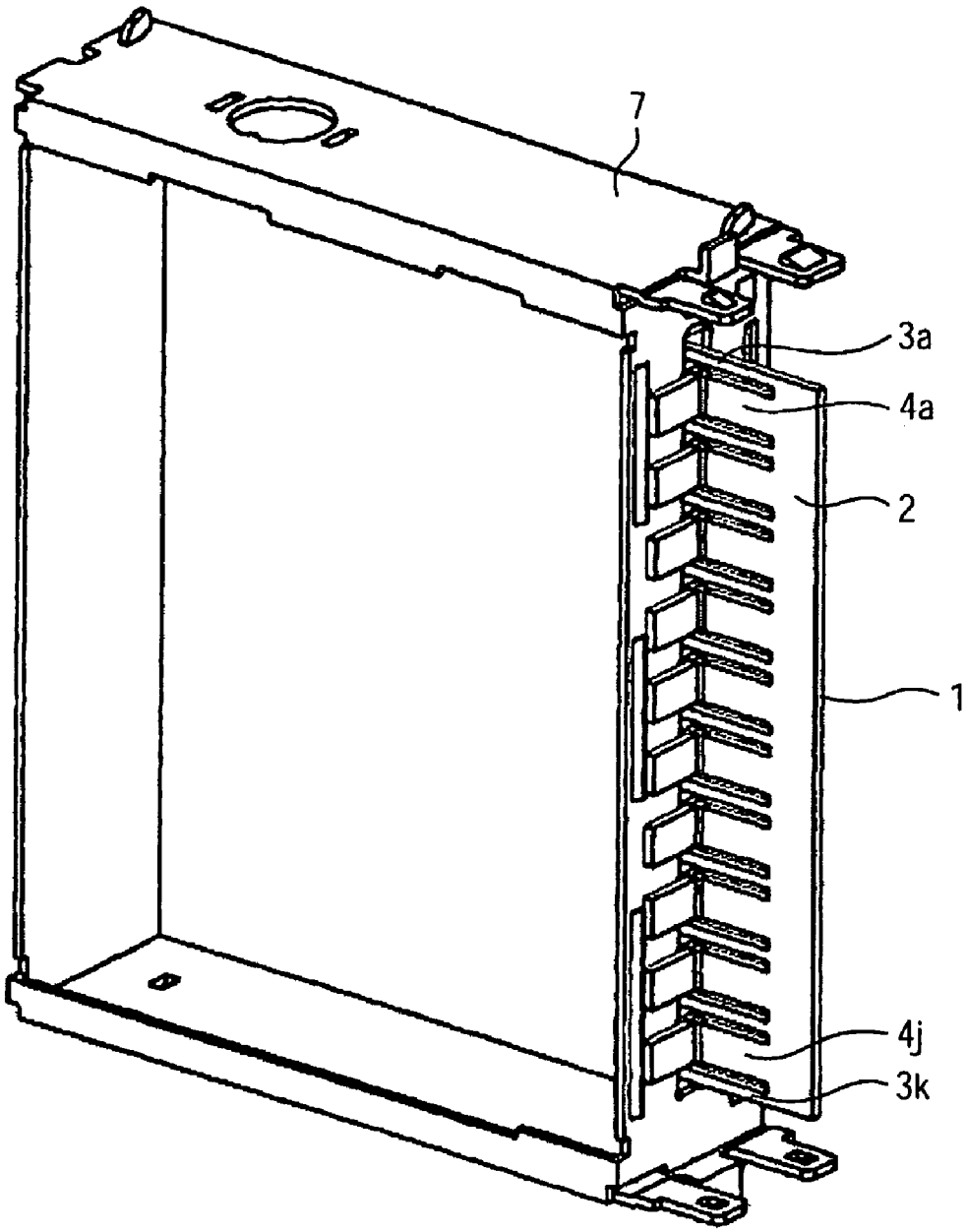
FIG. 3 shows a signal receiver frame with the device.

FIG. 3 shows the device 1 provided in the signal receiver frame 7. The device 1 is mounted on the frame 7 prior to the beginning of the soldering process. The connection elements 3*a* . . . 3*k* of the device 1 are then inserted into holes provided in the printed circuit board (not shown) for this purpose. The connection elements 3*a* . . . 3*k* are meanwhile supported via the detainers 4*a* . . . 4*j*. The projections 5 and 6 of each connection element 3*a* . . . 3*k* bear on the printed circuit board.

During the soldering process the necessary soldered connections are established between the connection elements and the printed circuit board. Not only the printed circuit board, but also the entire device 1 is then subject to high temperatures.

After completion of the soldering process, the connection strip 2 as well as the detainers 4*a* . . . 4*j* are removed. The remaining connection elements 3*a* . . . 3*k* constitute electrical connections to other electrical printed circuit boards of an apparatus.

The invention claimed is:

1. A device comprising:

a plurality of connection elements extending outwardly from a common planar base and having a bent end portion extending substantially normal to the plane of said base; and a respective detainer extending outwardly from said planar base coplanar with said plurality of connection elements, said respective detainer having a bent end portion extending substantially normal to the plane of said base in a direction opposite to the direction of said connection element bent portion, and at least one said detainer being provided between each two adajacent connection elements, the end portions of said connection elements defining a plane which extends parallel to a plane defined by the end portions of said detainers.

2. The device of claim 1, wherein the device consists of one piece.

3. The device of claim 1 wherein the connection elements and detainers are L-shaped.

4. The device of claim 1 wherein the connection elements, the detainers and the connection stips uniformly consist of an electrically conductive material.

5. The device of claim 1 wherein each end portion of the connection elements is provided with at least one projection.

6. An arrangement which include a frame, notably for receiving a printed circuit board for a signal receiver with a device connected to the frame, which devise comprises:

a plurality of connection elements extending outwardly from a common planar base and having a bent end portion extending substantially normal to the plane of said base; and a respective detainer extending outwardly from said planar base coplanar with said plurality of connection elements, said respective detainer having a bent end portion extending substantially normal to the plane of said base in a direction opposite to the direction of said connection element bent portion, and at least one said detainer being provided between each two adjacent connection elements, the end portions of said connection elements defining a plane which extends parallel to a plane defined by the end portions of said detainers.

7. The device of claim 1 wherein said bent end portion of said connection element and said bent end portion of said detainer which extends in a direction opposite from said common base plane lie In respective parallel spaced planes.

* * * * *